US005713516A

United States Patent [19]

Seong

[11] Patent Number: 5,713,516

[45] Date of Patent: Feb. 3, 1998

[54] ALERT AIR CONDITIONING CONTROL METHOD FOR AIR CONDITIONER FOR ENHANCING LEARNING EFFICIENCY

[75] Inventor: See-Poong Seong, Seoul, Rep. of Korea

[73] Assignee: LG Electronics Inc., Rep. of Korea

[21] Appl. No.: 754,238

[22] Filed: Nov. 20, 1996

[30] Foreign Application Priority Data

Nov. 24, 1995 [KR] Rep. of Korea ..... 43646/1995

[51] Int. Cl.[6] ..... F24F 7/00; G05D 23/00

[52] U.S. Cl. ..... 236/49.3; 236/51; 236/91 C

[58] Field of Search ..... 236/49.3, 51, 91 C

[56] References Cited

U.S. PATENT DOCUMENTS 4,934,593 6/1990 Meyer ..... 236/78 D

FOREIGN PATENT DOCUMENTS 0025015 3/1981 Japan ..... 236/78 D 403156240 7/1991 Japan ..... 236/51

*Primary Examiner*—William E. Wayner

*Attorney, Agent, or Firm*—Ostrolenk, Faber, Gerb & Soffen, LLP

[57] ABSTRACT

An improved alert air conditioning control method for an air conditioner for enhancing a learning efficiency which is capable of significantly enhancing a learning efficiency of a user by providing a better air conditioning environment, whereby it is possible to increase an alert level of a user and improve an indoor environment. The method includes the steps of measuring and analyzing an electroencephalogram (EEG) of a testee during an operation of an air conditioner based on first, second and third set temperatures and a temperature variation width with respect to the first, second and third temperatures, computing a data of a temperature variation width with respect to the set temperature at which an alert level is highest, selecting an air current of the air conditioner having the highest alert level between a weak wind and a chaos wind, and controlling the operation of the air conditioner by using a data of the temperature variation width and an air current data selected.

9 Claims, 6 Drawing Sheets

ALERT AIR CONDITIONING CONTROL METHOD FOR AIR CONDITIONER FOR ENHANCING LEARNING EFFICIENCY

BACKGROUND OF THE INVENTION

1. Field of the Invention

The present invention relates to an alert air conditioning control method for an air conditioner for enhancing a learning efficiency, and in particular to an alert air conditioning control method for an air conditioner for enhancing a learning efficiency which is capable of significantly enhancing humans learning efficiency by increasing the alertness level of humanss.

2. Description of the Conventional Art

Generally, air conditioning is intended for maintaining a better indoor living environment by using air conditioner. In particular, such better indoor living environment is important for humans to work hard in an indoor work place. Therefore, in the industry, intensive studies have been conducted so as to improve indoor environment conditions.

The operation control process for a conventional air conditioner is performed by using a previously programmed operation method in a microcomputer. Namely, the operation control process for the air conditioner is performed by repeating an ON/OFF operation of a compressor in accordance with a set temperature, so that a predetermined indoor temperature is maintained.

Therefore, the operation control method for a conventional air conditioner has disadvantages in that since the on/off operation is repeatedly performed in the compressor, the standard operation is performed irrespective of a user's desire, so that it is impossible to satisfy the desire of each individual.

In particular, in the conventional art, the operation of the air conditioners did not consider the alertness level of the user.

SUMMARY OF THE INVENTION

Accordingly, it is an object of the present invention to provide an alert air conditioning control method for an air conditioner for enhancing a learning efficiency which overcomes the problems encountered in the conventional art.

It is another object of the present invention to provide an improved alert air conditioning control method for an air conditioner for enhancing a learning efficiency which is capable of effectively controlling the air conditioning environment with respect to a user's desire and the usage purpose of the air conditioner by measuring an electroencephalogram of humans.

It is another object of the present invention to provide an improved alert air conditioning control method for an air conditioner for enhancing a learning efficiency which is capable of significantly enhancing a learning efficiency of a user by providing a better air conditioning environment, whereby it is possible to increase an alertness level of a user and improve an indoor environment.

To achieve the above objects, there is provided an alert air conditioning control method for an air conditioner for enhancing a learning efficiency which includes the steps of measuring and analyzing an electroencephalogram (EEG) of a testee during an operation of an air conditioner based on first, second and third set temperatures and a temperature variation width with respect to the first, second and third temperatures, computing a data of a temperature variation width with respect to the set temperature at which an alert level is highest, selecting an air current of the air conditioner having the highest alert level between a weak wind and a chaos wind, and controlling the operation of the air conditioner by using a data of the temperature variation width and an air current data selected.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
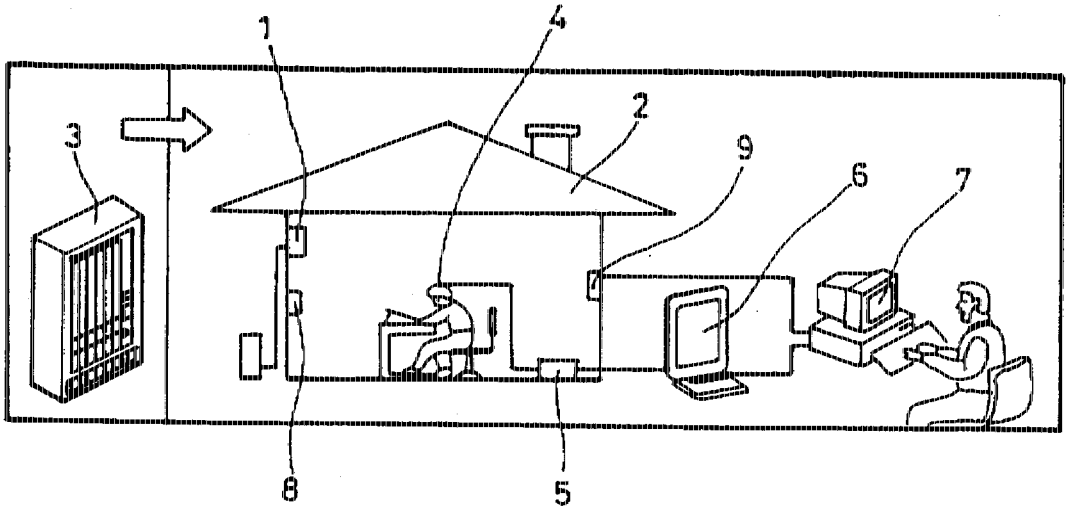
FIG. 1 is a view illustrating a testing apparatus for measuring a variation of electroencephalogram under a specific environment according to the present invention.

FIG. 1 is a view illustrating a testing apparatus for measuring a variation of electroencephalogram under a specific environment according to the present invention.

As shown therein, an air conditioner 1 is installed in a model house 2 in which an outdoor temperature/outdoor moisture and an indoor temperature/indoor moisture are controlled so that outdoor factors can not affect an electroencephalogram (EEG) of a humans.

The above-described testing apparatus further includes an amplifier 5 for amplifying an EEG from an EEG sensor 4, an EEG recorder 6 for recording the amplified EEG, and an EEG analysis personal computer (PC) 7 for storing the EEG recorded in the EEG recorder 6. In addition, there are further provided an audio signal generator 8 and a visual signal generator 9 in the model house 2 for gathering testee's various senses.

The EEG which is used for the present invention is classified as in the following table I.

TABLE I

| EEG | Frequency | Amplitude | State of consciousness | Examples |
|---|---|---|---|---|
| β | 14~25 Hz | 2~20 μV | guard, alert | anxious, stress, usual activity |
| α | 8~14 Hz | 5~100 μV | alert, stress relaxation | concentrating, meditating |
| θ | 4~8 Hz | 5~100 μV | sleeping | semi-conscious |
| δ | 0.5~4 Hz | 2~200 μV | sleeping | in deep sleep |

As shown in Table I, the EEG is classified into a frequency and an amplitude. In the present invention, the amplitude of β-waveform is measured. In addition, if the EEG voltage is high, the alert level is high. This result means that it is possible to increase the learning efficiency under the above-described air conditioning environment.

The amplitude of the EEG is used to measure the alert level. During the experiment, a statistical processing package program which is called "Statistical Package for the Social Science—SPSS" was used for analyzing the amplitude of β-waveform.

As the EEG measuring method adapted in the experiment as shown in Table I, a method of attaching sensors to 10 through 20 points on the head of the testee was used. However, since the regions of brain, where is sensitive to an external factor, are known in the art, a method of testing the EEG with respect to a predetermined number of head points has been used in the industry.

Figure 2A:
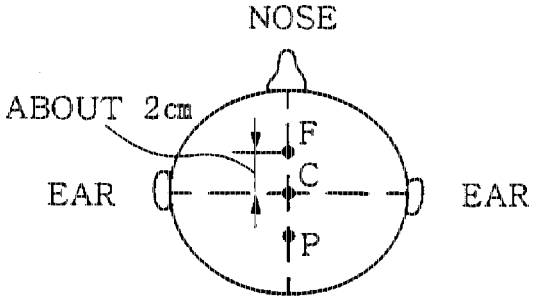
FIG. 2A is a view illustrating an electroencephalogram measuring portion of a humans body.

As shown in FIG. 2A, three points of Frontal portion "F", Central portion "C", and Parietal portion "P" are selected, and the EEG was measured with respect to the portions F, C, and P. Among theses points, the point "F" was most sensitive and then used for the experiment.

Figure 2B:
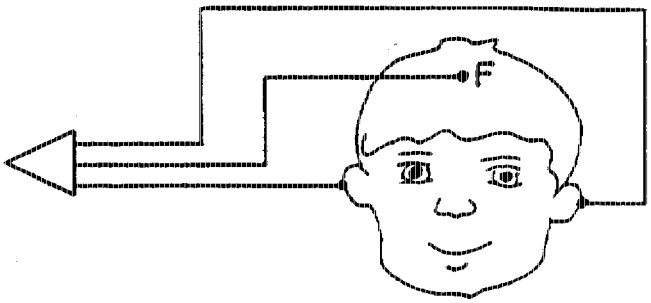
FIG. 2B is a view illustrating an electroencephalogram sensor attaching position according to the present invention.

As a method for attaching the EEG sensors to the head of the testee, there are a unipolar method and a bipolar method. As shown in FIG. 2B, the unipolar method of measuring the potential difference between the reference point "F" and ears of the testee was used.

The EEG measuring methods will now be explained in more detail.

First, the outdoor temperature of the model house in which the testee stays is set to the temperature of summer season by using an outdoor air conditioner 3. Here, the moisture is maintained to 60%.

As shown above, the air conditioner is operated after the outdoor temperature of the model house is set.

The temperature in the model house is set to a first set temperature T1 of 24° C., a second set temperature T2 of 26° C., and a third set temperature T3 of 28° C., respectively, and a first temperature variation width t1 is set to ±1.0° C., and a second temperature variation width t2 is set to ±1.5° C., and a third temperature variation width t3 is set to ±2.0° C., respectively. In addition, the EEG is measured by varying the current into a weak current and a chaos current.

Figure 3:
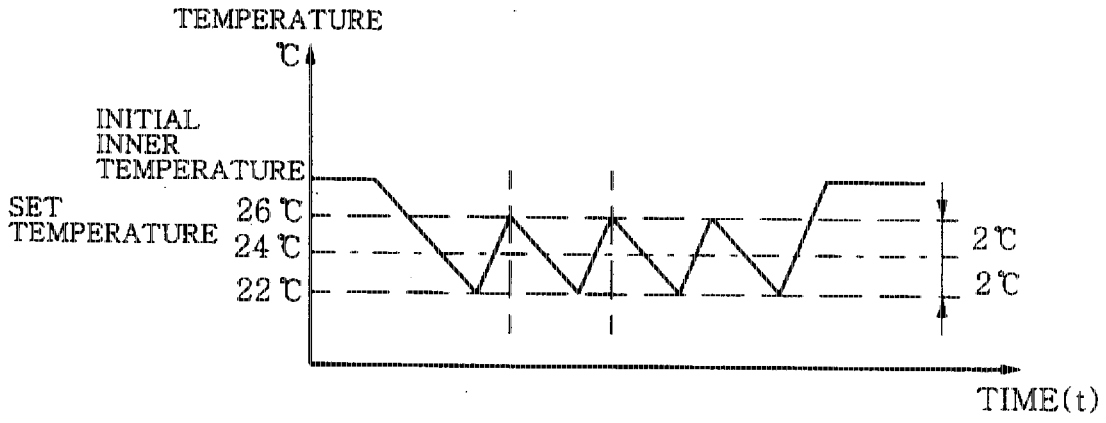
FIG. 3 is a graph so as to explain the relationship between a first set temperature (24° C.) and a third temperature variation width (±2° C.) according to the present invention.

FIG. 3 is a graph illustrating the relationship between a first set temperature T1 of 24° C. and a third temperature variation width t3 (±2° C.) with respect to the first set temperature T1 of 24° C. As shown therein, when the temperature becomes 26° C. based on the third set temperature, the compressor (not shown) of the air conditioner is turned on, and when the indoor temperature drops to 22° C., the compressor is turned off. When the compressor is turned off, the dropped temperature is increased. The above-described temperature increasing and dropping is repeated until the room temperature becomes identical to the set temperature.

Under the conditions of the first T1, second T2 and third set temperatures T3 and the first t1, second t2 and third temperature variation widths t3, the EEG of the testee is measured by using the EEG sensors 4 attached on the head of the testee. Since the EEG signal measured by the EEG sensors 4 are weak, more higher amplitude is necessary. Therefore, the amplifier 5 amplifies the EEG signal and transmits the EEG signal to the EEG recorder 6.

In addition, the EEG signal amplified by the amplifier 5 is transmitted to the EEG analysis PC 7 for storing. The EEG analysis PC 7 converts the analog signal inputted thereto into a digital signal by using an A/D converter (not shown). The data stored is measured 30 times (the number of effective data) in each period of the increasing and dropping temperature at a sampling rate, and the average value thereof is computed.

Since the EEG measurement is directed to checking the variation characteristic of the EEG based on the variation of the air conditioning condition, it is necessary to block external conditions which affects other possible EEGs. Therefore, a method of blocking external factors is used by providing the testee with a specific impact. This method is called a protocol.

Figure 4A:
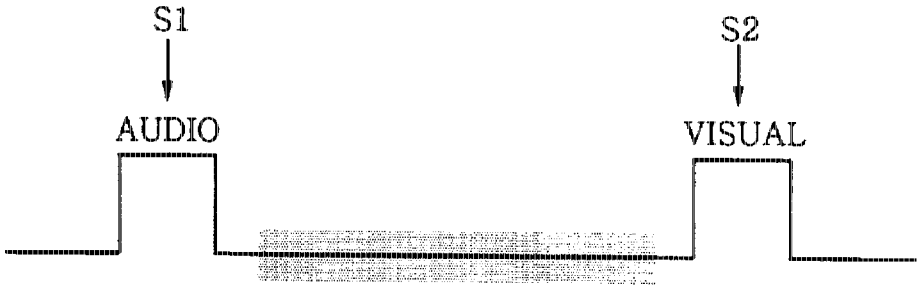
FIG. 4A is a view illustrating a protocol used for an electroencephalogram measurement and analysis according to the present invention.

The present invention uses the protocol which combines the audio signal and the visual signal. The experiment technique using the protocol as shown in FIG. 4A will now be explained in more detail.

First, if there is a beeping noise which is related to the audio signal, is outputted from the audio signal generator 8 in accordance with the protocol, the testee has stress for being ready for an alert. After a lapse of 1.8 seconds, a red light and a blue light of the visual signal generator 9 are alternately and randomly turned on. The testee presses a lighted key of a keyboard (not shown) in response to the visual signal applied to the testee. At this time, the testee must rapidly react with respect to the lighted key. In addition, the testee must think of the protocol without being controlled by other external factors. Generally, since the EEG is known as a biological reaction, when restricting the external factors by using the protocol, it is possible to measure the EEG variation based on the variation of the air conditioning conditions.

As described above, as the audio signal and visual signal occur for 5 seconds, the testee reacts with respect to the signals. At this time, the EEG of the testee is measured. The EEG analysis PC 7 analyzes the EEG of the testee based on the result of the measurement.

When a first impact signal S1 and a second impact signal S2 are provided at a predetermined interval by using the protocol, a CNV method of analyzing the characteristic of the EEG is used.

This method was suggested by Walter in 1964. Namely, the characteristic of the EEG is referred to an amplitude shift of the EEG which occurs when the testee expects a predetermined result after the first impact is supplied thereto.

Figure 4B:
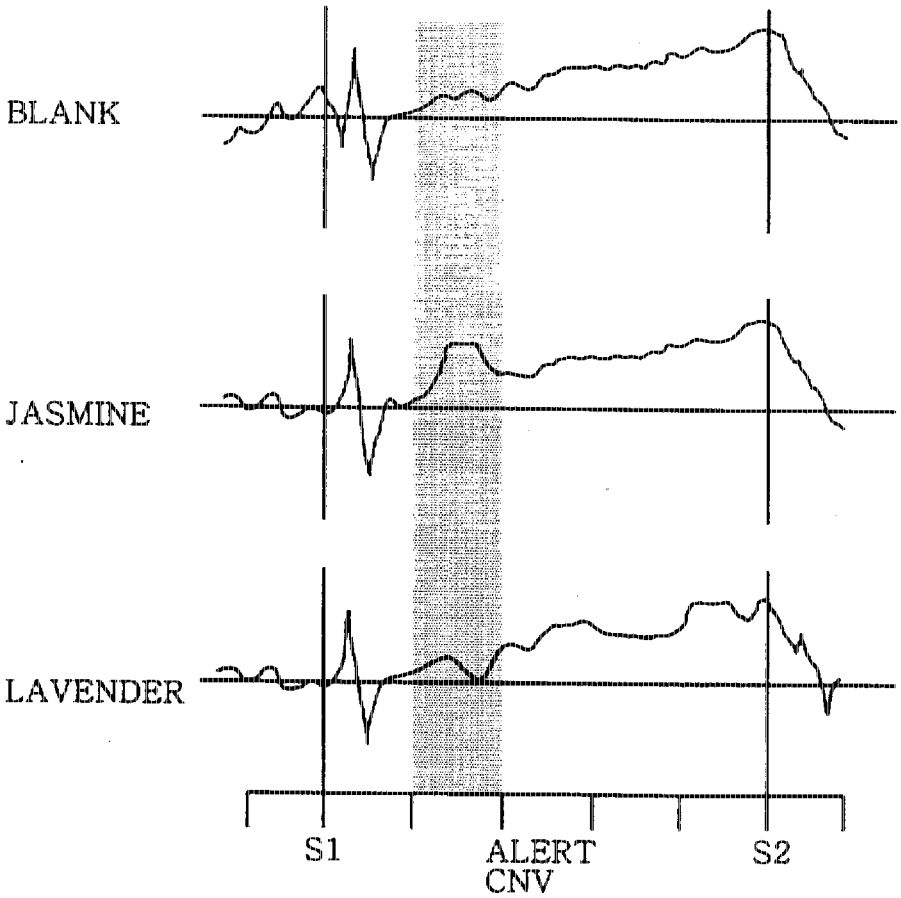
FIG. 4B is a view illustrating a contingent negative variation (CNV) due to fragrance according to the present invention.

For example, FIG. 4B is a view illustrating a contingent negative variation due to fragrance according to the present invention. Namely, when one fragrance such as Blank, Jasmine and Lavender is repeatedly supplied to the testee, and the first and second impact signals S1 and S2 are provided thereto as well, a result is shown as a variation of the CNV in FIG. 5B.

As shown therein, the amplitude shift is seen in the dotted portion after the first impact S1 is supplied to the testee. Namely, this amplitude shift denotes a stress level of the testee with respect to whether another impact will occur after the first impact S1 occurred. It is possible to judge the amplitude of the alert by using the amplitude shift.

Figure 5:
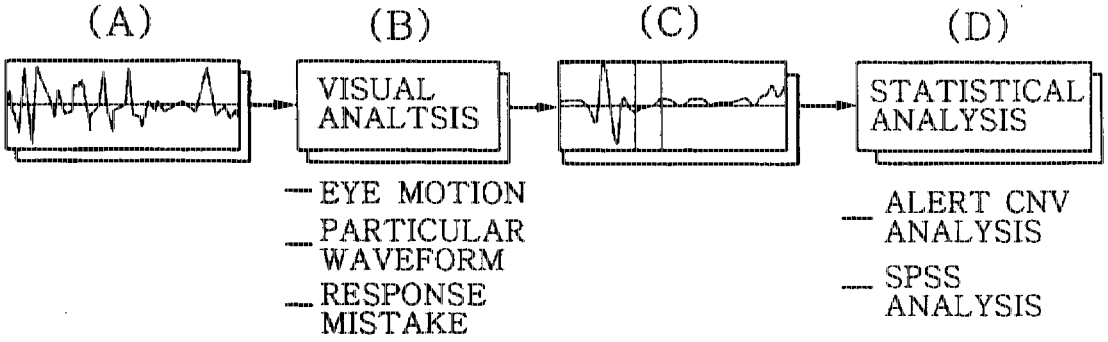
FIG. 5 is a view so as to explain an electroencephalogram analysis process according to the present invention.

FIG. 5 is a view so as to explain electroencephalogram analysis processes according to the present invention.

The method of analyzing the EEG will now be explained with reference to FIG. 5.

First, all the EEGs which are affected by noise due to a response error and blink of the testee based on the visual analysis "B" in the original data "A" obtained by the EEG recorder 6 are removed. Thereafter, the average of the remaining 30 effective data sets is computed, for thus computing an average data "C". In addition, the amplitude of the alert is computed from the average data.

Table 2 shows the result of the working experiment for achieving the optimum alertness under the conditions of the standard temperatures T1,T2,T3 and the ranges of the temperature variation t1, t2, t3.

TABLE 2

| T | | E° C | R |
|---|---|---|---|
| T1 | t1 | 24 ± 1.0° C., weak air | t1 > t3,t2 |
| | t2 | 24 ± 1.5° C., weak air | |
| | t3 | 24 ± 2.0° C., weak air | |
| T2 | t1 | 26 ± 1.0° C., weak air | t2 > t3 >> t1 |
| | t2 | 26 ± 1.5° C., weak air | |
| | t3 | 26 ± 2.0° C., weak air | |
| T3 | t1 | 28 ± 1.0° C., weak air | t1 >> t2,t3 |
| | t2 | 28 ± 1.5° C., weak air | |
| | t3 | 28 ± 2.0° C., weak air | |
| air current | L | 26 ± 1.5° C., weak air | CH >>> L > G |
| | CH | 26 ± 1.5° C., chaos air | |
| | G | 25.6 ± 1.8° C., weak air | |

* T: temperature (0° C.)
E C: experiment condition
R: result of statistics analysis
L: weak
CH: chaos
G: weak in conventional air conditioning Here, the amplitude of β wave was used as the analysis data. In the result of statistical analysis, ">" means that the value is always larger with 90% reliability, ">>" means that the value is always larger with 95% reliability, and ">>>" means that the value is always larger with 99% reliability.

As shown in table II, when the temperature is set at the first set temperature T1, the first temperature variation width t1 has the highest alert level, and when the temperature is set at the second set temperature T2, the second temperature variation width t2 has the highest alert level, and when the temperature is set at the third set temperature T3, the first temperature variation width t1 has the highest alert level. In addition, when the temperature is set at the second set temperature T2, the temperature variation width t2 has the highest alert level.

Also, regarding the air current, the alert level in chaos wind is higher than that in weak wind.

Here, the data is obtained based on the value for 0.35 through 0.65 second after the first impact S1, and a credibility is obtained by the SPSS analysis.

The EEG is analyzed through the above-described EEG analysis method. The data of the temperature variation width with respect to each set temperature having higher alert level is stored by using the analyzed EEG, thereby controlling the air conditioner based on the stored data, whereby it is possible to provide a desired air conditioning environment which is capable of increasing the alert level of a user, for thus enhancing the learning efficiency of the user.

In addition, in the case of the air current, the following experiment was conducted so as to compare the alert levels between a weak wind and a chaos wind. In other words, the experiment was conducted under the alert air conditioning condition having the highest alert level and the usual air conditioning condition. In addition, two learning subjects were provided to the testee, and then the processing capabilities of the learning subjects were compared.

The first learning subject is classified into an impact item and a reaction item, and then the correct ratio with respect to the reaction item was analyzed.

As the impact items, 10 pairs of the words of which two pair of words which the testee can understand their meaning and another two pair of words which the testee can not understand their meaning are provided. In addition, the testee is requested to react with respect to the words provided thereto and conceive on whether there is a predetermined relationship between the words provided. In addition, another pair of words are provided to the testee. Thereafter, the correct rate is analyzed.

The second learning subject is to check the target which randomly moves on the screen. During this second learning subject, the testee is requested to react with respect to a specific motion of the target which suddenly moves on the screen, and then the correct ratio and the reaction time are measured.

Figure 6A:
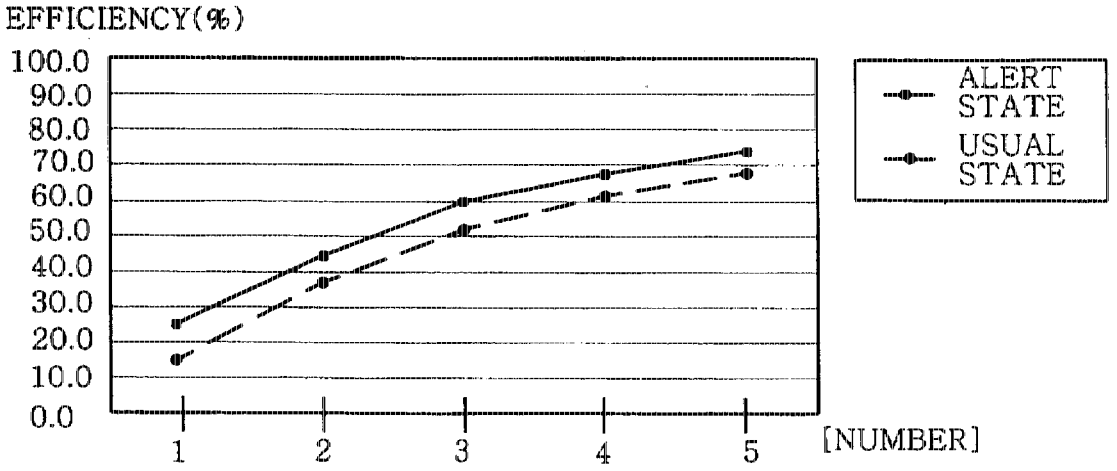
FIG. 6A is a graph so as to explain a learning of an alert air conditioning and a usual air conditioning when performing a first learning subject under an air conditioning environment in accordance with an alert air conditioning control method for an air conditioner according to the present invention.

FIG. 6A is a graph so as to explain a learning of an alert air conditioning and a usual air conditioning when performing a first learning subject under an air conditioning environment in accordance with an alert air conditioning control method for an air conditioner according to the present invention.

As shown therein, in the case that the first learning subject is provided, and the air current is the chaos wind, the relationship between the usual air conditioning and the alert conditioning are compared. As a result, the learning efficiency which was obtained during the alert air conditioning was increased by more than about 7% compared to the usual air conditioning.

Figure 6B:
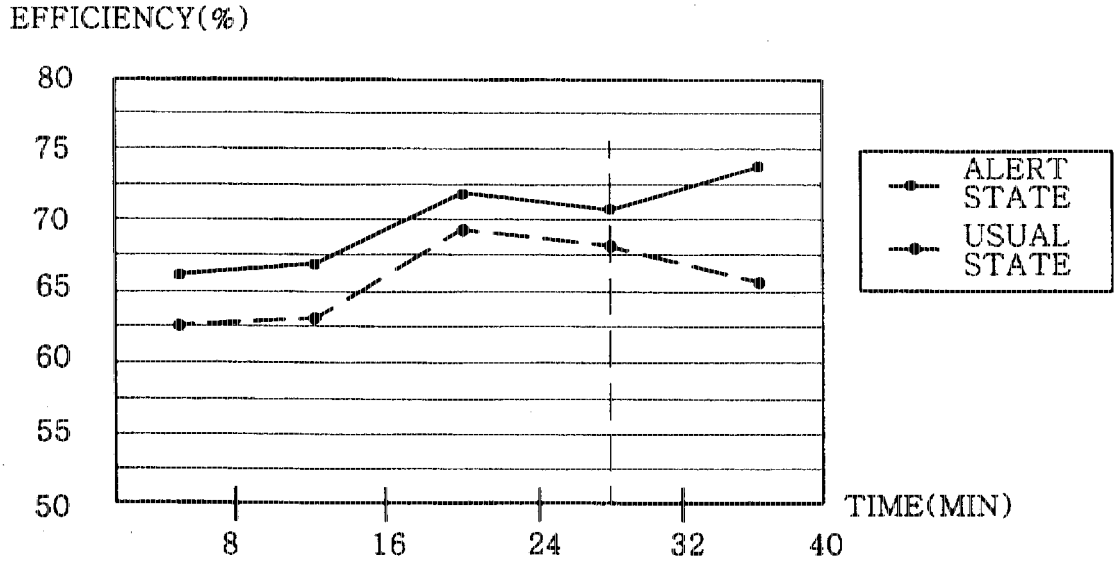
FIG. 6B is a graph so as to explain a learning of an alert air conditioning and a usual air conditioning when performing a second learning subject under an air conditioning environment in accordance with an alert air conditioning control method for an air conditioner according to the present invention.

FIG. 6B is a graph so as to explain a learning of an alert air conditioning and a usual air conditioning when performing a second learning subject under an air conditioning environment in accordance with an alert air conditioning control method for an air conditioner according to the present invention.

In the case of the second learning subject, identically to the first learning subject, when the air current is the chaos wind, the learning efficiency which was obtained during the alert air conditioning was significantly increased compared to the usual air conditioning. In particular, a significant efficiency degradation appeared after 30 minutes during the usual air conditioning; however, the learning efficiency was significantly increased during the alert air conditioning, thereby increasing the learning efficiency.

As described above, it is possible to obtain an optimum result in the chaos wind rather than the weak wind.

Figure 7:
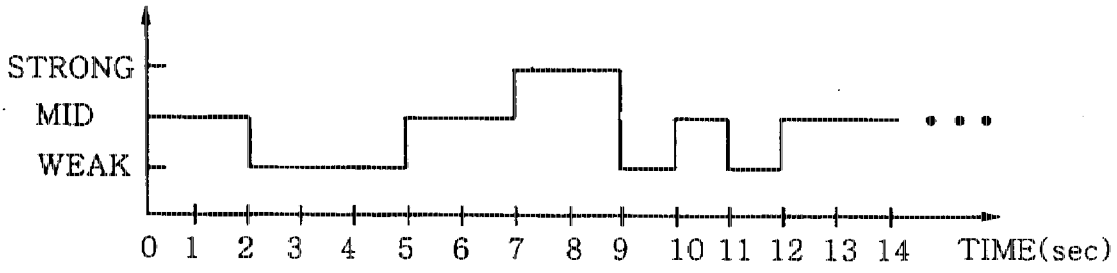
FIG. 7 is a graph so as to explain a variation of air current based on a lapse of time when generating air current in a chaos form which is adapted to the present invention.

FIG. 7 is a graph so as to explain a variation of air current after a lapse of time when generating air current in chaos form which is adapted to the present invention.

As shown therein, the chaos wind is provided by driving the air conditioner in the mid wind mode for 2 seconds, and then in the weak wind mode for 3 seconds, and then in the mid wind mode for 2 seconds, and then in the strong wind mode for 2 seconds, and finally in the weak wind mode for 1 second, for thus changing the air current.

Here, the chaos wind means a wind similar to the natural wind, which is obtained by analyzing the natural wind, compensating a transfer function based on the fan motor of the air conditioner and the inner space with respect to the natural wind, and applying the control signal to the fan motor of the air conditioner.

As described above, the alert air conditioning control method for an air conditioner for enhancing a learning efficiency according to the present invention is directed to driving the air conditioner, for thus providing an optimum alert level in accordance with the temperature and air current, whereby it is possible to provide an air conditioning environment which is capable of increasing the alert level of a user, for thus improving the learning efficiency of the user.

In addition, since it is possible to select the alert mode in accordance with the individual preference and temperature, for thus maximizing the air conditioning environment and alert level of the user.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An alert air conditioning control method for an air conditioner for enhancing a learning efficiency, comprising the steps of:

measuring and analyzing an electroencephalogram (EEG) of a testee during an operation of an air conditioner based on first, second and third set temperatures and a temperature variation width with respect to the first, second and third temperatures;

computing a data of a temperature variation width with respect to the set temperature at which an alert level is highest;

selecting an air current of the air conditioner having the highest alert level between a weak wind and a chaos wind; and controlling the operation of the air conditioner by using a data of the temperature variation width and an air current data selected.

2. The method of claim 1, wherein said EEG is measured at the first set temperature, the second set temperature, and the third set temperature, respectively.

3. The method of claim 1, wherein said EEG is measured at the first set temperature and the temperature variation width thereat, the second set temperature and the temperature variation width thereat, and the third set temperature and the temperature variation width thereat.

4. The method of claim 1, wherein said EEG uses an amplitude of β-waveform.

5. The method of claim 1, wherein said air current uses a chaos wind.

6. The method of claim 1, wherein in said EEG measuring step, a protocol is used in order for a reaction of the testee to react with respect to an air conditioning condition variation irrespective of other external factors.

7. The method of claim 6, wherein said protocol is used in order for the testee to react by outputting a first impact factor and providing a second impact factor after predetermined time.

8. The method of claim 1, wherein in said EEG measuring and analyzing step, the level of the alert is measured by using a contingent negative variation (CNV).

9. The method of claim 1, wherein said EEG measuring and analyzing step includes the sub-steps of:

removing an EEG which is affected by noise such as a wink of eye based on a visual analysis from the original data;

computing an average data by computing an average of the remaining effective data set after the removing step; and computing the level of an alert from the average data.

* * * * *